US011252991B2

(12) United States Patent
Silvestrini

(10) Patent No.: US 11,252,991 B2
(45) Date of Patent: Feb. 22, 2022

(54) AEROSOL-GENERATING SYSTEM COMPRISING VARIABLE AIR INLET

(71) Applicant: Philip Morris Products S.A., Neuchatel (CH)

(72) Inventor: Patrick Charles Silvestrini, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 333 days.

(21) Appl. No.: 16/061,110

(22) PCT Filed: Dec. 19, 2016

(86) PCT No.: PCT/EP2016/081807
§ 371 (c)(1),
(2) Date: Jun. 11, 2018

(87) PCT Pub. No.: WO2017/108721
PCT Pub. Date: Jun. 29, 2017

(65) Prior Publication Data

US 2018/0360123 A1 Dec. 20, 2018

(30) Foreign Application Priority Data

Dec. 21, 2015 (EP) ..... 15201767

(51) Int. Cl.
*A24D 1/00* (2020.01)
*A24F 40/30* (2020.01)
(Continued)

(52) U.S. Cl.
CPC ..... *A24D 1/002* (2013.01); *A24B 15/167* (2016.11); *A24F 7/02* (2013.01); *A24F 40/30* (2020.01);
(Continued)

(58) Field of Classification Search
CPC ..... A24F 47/002; A24F 47/008; A61M 15/06
See application file for complete search history.

(56) References Cited

U.S. PATENT DOCUMENTS

2007/0062548 A1* 3/2007 Horstmann ..... A61M 15/0003 131/270
2013/0192615 A1 8/2013 Tucker et al.
(Continued)

FOREIGN PATENT DOCUMENTS

CN 2400701 Y 10/2000
CN 203762303 U 8/2014
(Continued)

OTHER PUBLICATIONS

Extended European Search Report dated Jun. 15, 2016 in European Patent Application No. 15201767.9, 7 pages.
(Continued)

*Primary Examiner* — Eric Yaary
*Assistant Examiner* — Jennifer A Kessie
(74) *Attorney, Agent, or Firm* — Oblon, McClelland, Maier & Neustadt, L.L.P.

(57) ABSTRACT

There is provided an aerosol-generating system including a cartridge including: a first compartment containing a nicotine source, the first compartment having a first air inlet and a first air outlet; and a second compartment containing an acid source, the second compartment having a second air inlet and a second air outlet; and a mouthpiece configured to engage with the cartridge to define a chamber in fluid communication with the first air outlet and the second air outlet, the mouthpiece comprising a third air inlet in fluid communication with the chamber and a third air outlet in fluid communication with the chamber, the third air inlet defining a flow area, and the mouthpiece being configured so that the flow area through the third air inlet is variable.

17 Claims, 3 Drawing Sheets

(51) Int. Cl.

| | |
|---|---|
| ***A24F 40/42*** | (2020.01) |
| ***A24F 40/485*** | (2020.01) |
| ***A24B 15/167*** | (2020.01) |
| ***A24F 7/02*** | (2006.01) |
| ***A24F 40/10*** | (2020.01) |

(52) U.S. Cl.
CPC ..... *A24F 40/42* (2020.01); *A24F 40/485* (2020.01); *A24F 40/10* (2020.01)

(56) References Cited

U.S. PATENT DOCUMENTS

| | | | | |
|---|---|---|---|---|
| 2013/0192616 | A1 | 8/2013 | Tucker et al. | |
| 2013/0192619 | A1 | 8/2013 | Tucker et al. | |
| 2013/0192620 | A1 | 8/2013 | Tucker et al. | |
| 2013/0192621 | A1 | 8/2013 | Li et al. | |
| 2013/0192622 | A1 | 8/2013 | Tucker et al. | |
| 2013/0192623 | A1 | 8/2013 | Tucker et al. | |
| 2015/0245654 | A1 | 9/2015 | Memari et al. | |
| 2015/0245655 | A1 | 9/2015 | Memari et al. | |
| 2015/0245656 | A1 | 9/2015 | Memari et al. | |
| 2015/0245657 | A1 | 9/2015 | Memari et al. | |
| 2015/0245662 | A1 | 9/2015 | Memari et al. | |
| 2015/0245663 | A1 | 9/2015 | Memari et al. | |
| 2015/0245664 | A1 | 9/2015 | Memari et al. | |
| 2015/0245665 | A1 | 9/2015 | Memari et al. | |
| 2015/0245666 | A1 | 9/2015 | Memari et al. | |
| 2015/0245667 | A1 | 9/2015 | Memari et al. | |
| 2015/0245668 | A1 | 9/2015 | Memari et al. | |
| 2015/0351456 | A1* | 12/2015 | Johnson | A24F 47/008 131/329 |
| 2015/0359266 | A1 | 12/2015 | Memari et al. | |
| 2016/0022930 | A1* | 1/2016 | Greim | A61M 15/06 131/328 |
| 2016/0120229 | A1 | 5/2016 | Tucker et al. | |
| 2016/0150824 | A1 | 6/2016 | Memari et al. | |
| 2016/0165956 | A1 | 6/2016 | Tucker et al. | |
| 2016/0165957 | A1 | 6/2016 | Tucker et al. | |
| 2016/0183598 | A1 | 6/2016 | Tucker et al. | |
| 2016/0183599 | A1 | 6/2016 | Tucker et al. | |
| 2016/0192712 | A1 | 7/2016 | Memari et al. | |
| 2016/0192713 | A1 | 7/2016 | Memari et al. | |
| 2016/0286862 | A1 | 10/2016 | Silvetrini | |
| 2016/0360795 | A1 | 12/2016 | Tucker et al. | |
| 2017/0020199 | A1 | 1/2017 | Tucker et al. | |
| 2017/0042249 | A1 | 2/2017 | Tucker et al. | |
| 2018/0035718 | A1* | 2/2018 | Liu | A24F 47/00 |

FOREIGN PATENT DOCUMENTS

| | | | |
|---|---|---|---|
| CN | 104812259 | A | 7/2015 |
| CN | 104822281 | A | 8/2015 |
| CN | 104994757 | A | 10/2015 |
| EA | 015651 | B1 | 10/2011 |
| JP | 2010-532672 | A | 10/2010 |
| JP | 2015-500028 | A | 1/2015 |
| JP | 2015-504653 | A | 2/2015 |
| JP | 2015-504667 | A | 2/2015 |
| RU | 2012 101 204 | A | 7/2013 |
| WO | WO 2008/121610 | A1 | 10/2008 |
| WO | WO 2015/000974 | A1 | 1/2015 |
| WO | WO 2015/197627 | A1 | 12/2015 |
| WO | WO 2017/032695 | A1 | 3/2017 |
| WO | WO 2017/108983 | A1 | 6/2017 |

OTHER PUBLICATIONS

International Search Report and Written Opinion dated Mar. 22, 2017 in PCT/EP2016/081807 filed Dec. 19, 2016.

Combined Chinese Office Action and Search Report dated Jun. 3, 2020 in corresponding Chinese Patent Application No. 201680069593.4 (with English Translation), 16 pages.

Combine Russian Federation Office Action and Search Report dated May 27, 2020 in Patent Application No. 2018126636 (with English translation), 16 pages.

Notice of Allowance dated Nov. 30, 2020 in Japanese Patent Application No. 2018-551506 (with English translation), 4 pages.

Combined Chinese Office Action and Search Report dated Apr. 28, 2021 in corresponding Chinese Patent No. 201680069593.4 (with English translation), 19 pages.

* cited by examiner

AEROSOL-GENERATING SYSTEM COMPRISING VARIABLE AIR INLET

The present invention relates to an aerosol-generating system comprising a cartridge and a mouthpiece, the mouthpiece having a variable air inlet. The present invention finds particular application as an aerosol-generating system comprising a nicotine source and an acid source for the generation of an aerosol comprising nicotine salt particles.

Devices for delivering nicotine to a user and comprising a nicotine source and a volatile delivery enhancing compound source are known. For example, WO 2008/121610 A1 discloses devices in which nicotine and a volatile acid, such as pyruvic acid, are reacted with one another in the gas phase to form an aerosol of nicotine salt particles that is inhaled by the user.

When using an aerosol-generating system such as the type described in WO 2008/121610 A1, a user experience may be dependent on the reaction stoichiometry between the nicotine and the volatile delivery enhancing compound source. The user experience may be dependent on the total delivery of nicotine salt particles with each puff. The user experience may be dependent on the resistance to draw (RTD) through the aerosol-generating system.

It would be desirable to provide an aerosol-generating system that provides increased predictability or control over the reaction stoichiometry, the total delivery of nicotine salt particles, or the RTD through the aerosol-generating system.

According to the present invention there is provided an aerosol-generating system comprising a cartridge, the cartridge comprising a first compartment containing a nicotine source and a second compartment containing an acid source. The first compartment has a first air inlet and a first air outlet, and the second compartment has a second air inlet and a second air outlet. The aerosol-generating system further comprises a mouthpiece configured to engage with the cartridge to define a chamber in fluid communication with the first air outlet and the second air outlet. The mouthpiece comprises a third air inlet in fluid communication with the chamber and a third air outlet in fluid communication with the chamber, wherein the third air inlet defines a flow area, and wherein the mouthpiece is configured so that the flow area through the third air inlet is variable.

As used herein with reference to the invention, the term "air inlet" is used to describe one or more apertures through which air may be drawn into a component or portion of a component of the aerosol-generating system.

As used herein with reference to the invention, the term "air outlet" is used to describe one or more apertures through which air may be drawn out of a component or portion of a component of the aerosol-generating system.

As used herein with reference to the invention, the term "flow area" is used to describe the total area of an air inlet or an air outlet through which air flows during use. In embodiments in which an air inlet or an air outlet comprises a plurality of apertures, the flow area of the air inlet or the air outlet is the total flow area of the plurality of apertures. In embodiments in which the cross-sectional area of an air inlet or an air outlet varies in the direction of airflow, the flow area of the air inlet or the air outlet is the minimum cross-sectional area in the direction of airflow. In aerosol-generating systems according to the present invention, the flow area of the third air inlet is variable. That is, the aerosol-generating system is transformable between a plurality of configurations, wherein the flow area of the third air inlet is different between the different configurations. In a given configuration of the aerosol-generating system, the flow area of the third air inlet is the minimum cross-sectional area of the third air inlet, in the direction of airflow, for that configuration of the aerosol-generating system. At least one configuration may define a maximum flow area of the third air inlet. At least one configuration may define a minimum flow area of the third air inlet. Remaining configurations may define one or more flow areas of the third air inlet between the maximum flow area of the third air inlet and the minimum flow area of the third air inlet.

Advantageously, by providing the nicotine source and the acid source in separate first and second compartments with separate air inlets and separate air outlets, aerosol-generating systems according to the present invention facilitate control of the reaction stoichiometry between the nicotine and the acid. For example, the reaction stoichiometry may be controlled and balanced through variation of the volumetric airflow through the first compartment of the cartridge relative to the volumetric airflow through the second compartment of the cartridge.

Advantageously, by providing a mouthpiece defining a chamber in fluid communication with the first air outlet and the second air outlet, and comprising a third air inlet in fluid communication with the chamber and having a variable flow area, aerosol-generating systems according to the present invention facilitate control of the total delivery of nicotine salt particles per unit volume of airflow through the third air outlet. That is, varying the flow area of the third air inlet controls the total delivery of nicotine salt particles per unit volume of airflow through the third air outlet. Increasing the flow area of the third air inlet increases the volumetric airflow through the third air inlet compared to the total volumetric airflow through the first and second air outlets, which decreases the total delivery of nicotine salt particles per unit volume of airflow through the third air outlet. Decreasing the flow area of the third air inlet decreases the volumetric airflow through the third air inlet compared to the total volumetric airflow through the first and second air outlets, which increases the total delivery of nicotine salt particles per unit volume of airflow through the third air outlet.

Advantageously, providing a mouthpiece comprising a third air inlet having a variable flow area may also provide user control of the RTD through aerosol-generating systems according to the present invention. Increasing the flow area of the third air inlet may reduce the RTD of the aerosol-generating system. Decreasing the flow area of the third air inlet may increase the RTD of the aerosol-generating system.

Preferably, each of the first air inlet, the first air outlet, the second air inlet and the second air outlet is formed by one or more apertures. The ratio of the volumetric airflow through the first compartment relative to the volumetric airflow through the second compartment may be controlled through variation of one or more of the number, dimensions and location of apertures forming at least one of the first air inlet, the first air outlet, the second air inlet and the second air outlet. Such variations with respect to the number, dimensions and location of apertures may be fixed at the time of manufacture of the cartridge to provide a desired ratio of the volumetric airflow through the first compartment relative to the volumetric airflow through the second compartment, to provide a desired reaction stoichiometry between the nicotine and the acid.

Preferably, the mouthpiece comprises a first mouthpiece part and a second mouthpiece part moveable with respect to the first mouthpiece part, wherein relative movement between the first mouthpiece part and the second mouthpiece part varies the flow area through the third air inlet. The first mouthpiece part may be fixed with respect to the cartridge. The first mouthpiece part may be formed integrally with at least a portion of the cartridge. The first mouthpiece part may comprise a tubular portion extending from a downstream end of the cartridge.

The second mouthpiece part may be arranged to slide with respect to the first mouthpiece part. The second mouthpiece part may be arranged to twist with respect to the first mouthpiece part. The second mouthpiece part may be arranged for helicoidal movement with respect to the first mouthpiece part.

The third air inlet may be formed by one or more apertures. The one or more apertures may be provided in the first mouthpiece part. The one or more apertures may be provided in the second mouthpiece part. The one or more apertures may comprise one or more apertures in the first mouthpiece part and one or more apertures in the second mouthpiece part. Preferably, the second mouthpiece part is moveable with respect to the first mouthpiece part between a first position in which the one or more apertures are unobstructed and a second position in which at least a portion of the one or more apertures is obstructed. When the second mouthpiece part is in the second position, the one or more apertures may be only partially obstructed. The second mouthpiece part may be moveable with respect to the first mouthpiece part into a third position in which the one or more apertures are entirely obstructed.

As used herein with reference to the invention, by "unobstructed" it is meant that an aperture forming at least part of an air inlet or an air outlet is not blocked so that air can flow freely through the entire area of the aperture.

As used herein with reference to the invention, by "obstructed" it is meant that an aperture forming at least part of an air inlet or an air outlet is blocked such that airflow through the aperture is substantially prevented. An aperture may be partially obstructed, so that air can flow through only the portion of the aperture that is unobstructed.

The third air inlet may be formed by a plurality of apertures. When the second mouthpiece part is in the first position, preferably all of the apertures forming the third air inlet are unobstructed. When the second mouthpiece part is in the second position, each of the apertures forming the third air inlet may be only partially obstructed. When the second mouthpiece part is in the second position, some of the apertures forming the third air inlet may be unobstructed, and the remainder of the apertures forming the third air inlet may be entirely obstructed. When the second mouthpiece part is in the second position, all of the apertures forming the third air inlet may be entirely obstructed.

In those embodiments in which the third air inlet is formed by a plurality of apertures and the second mouthpiece part is moveable into a third position with respect to the first mouthpiece part, all of the apertures forming the third air inlet may be entirely obstructed when the second mouthpiece part is in the third position.

In any of the embodiments described above, the maximum flow area of the third air inlet is preferably between about 1.5 square millimetres and about 2 square millimetres. In embodiments in which the mouthpiece comprises a first mouthpiece part and a second mouthpiece part moveable with respect to the first mouthpiece part between a first position and a second position, preferably the maximum flow area of the third air inlet is provided when the second mouthpiece part is in the first position.

The third air inlet may be formed from a plurality of apertures. In such embodiments, the total maximum flow area through the apertures forming the third air inlet is preferably between about 1.5 square millimetres and about 2 square millimetres. The apertures forming the third air inlet may have the same maximum flow area so that the total maximum flow area of the third air inlet is divided equally between the apertures forming the third air inlet. The apertures forming the third air inlet may have different maximum flow areas so that the total maximum flow area of the third air inlet is divided unequally between the apertures forming the third air inlet. In embodiments in which the mouthpiece comprises a first mouthpiece part and a second mouthpiece part moveable with respect to the first mouthpiece part between a first position and a second position, preferably the maximum flow area of the third air inlet is provided when the second mouthpiece part is in the first position and all of the apertures forming the third air inlet are unobstructed.

In any of the embodiments described above, the minimum flow area of the third air inlet is preferably less than about 0.6 square millimetres. The minimum flow area of the third air inlet may be about zero. That is, the minimum flow area of the third air inlet may correspond to complete obstruction of the third air inlet. In embodiments in which the mouthpiece comprises a first mouthpiece part and a second mouthpiece part moveable with respect to the first mouthpiece part between a first position and a second position, the minimum flow area of the third air inlet may be provided when the second mouthpiece part is in the second position. In those embodiments in which the second mouthpiece part is moveable into a third position, the minimum flow area of the third air inlet may be provided when the second mouthpiece part is in the third position.

The third air inlet may be formed from a plurality of apertures. In such embodiments, the total minimum flow area through the apertures forming the third air inlet is preferably less than about 0.6 square millimetres. The total minimum flow area through the apertures forming the third air inlet may be about zero. That is, the minimum flow area of the third air inlet may correspond to complete obstruction of the apertures forming the third air inlet. In embodiments in which the mouthpiece comprises a first mouthpiece part and a second mouthpiece part moveable with respect to the first mouthpiece part between a first position and a second position, the minimum flow area of the third air inlet may be provided when the second mouthpiece part is in the second position and at least some of the apertures forming the third air inlet are at least partially obstructed. In those embodiments in which the second mouthpiece part is moveable into a third position, the minimum flow area of the third air inlet may be provided when the second mouthpiece part is in the third position.

In any of the embodiments described above, the third air inlet may be formed from one or more apertures. Preferably, the total number of apertures forming the third air inlet is between 2 and 10. In some embodiments, at least part of the mouthpiece has a substantially circular cross-sectional shape about which the apertures forming the third air inlet are provided. Preferably, the apertures forming the third air inlet are spaced equally about the mouthpiece.

In embodiments in which the third air inlet is formed from one or more apertures, each aperture may have any suitable cross-sectional shape. The cross-sectional shape of each aperture may be square, rectangular, circular or elliptical. Preferably, each aperture has a substantially circular cross-sectional shape. Preferably, the diameter of each aperture is between about 0.4 millimetres and about 0.6 millimetres.

In embodiments in which the third air inlet is formed from one or more apertures, the one or more apertures may be elongate. In embodiments in which the mouthpiece comprises a first mouthpiece part and a second mouthpiece part moveable with respect to the first mouthpiece part, preferably the longest dimension of each elongate aperture extends substantially in the direction of relative movement between the first mouthpiece part and the second mouthpiece part. Advantageously, forming the third air inlet from one or more elongate apertures allows the flow area through the third air inlet to be continuously varied as one or more of the elongate apertures is progressively obstructed or unobstructed. For example, in embodiments in which the mouthpiece comprises a first mouthpiece part and a second mouthpiece part moveable with respect to the first mouthpiece part, the flow area of one or more of the elongate apertures may be continuously varied as the second mouthpiece part is moved relative to the first mouthpiece part.

Each of the one or more elongate apertures may have any suitable cross-sectional shape. For example, the cross-sectional shape of each elongate aperture may be substantially rectangular or substantially elliptical.

The third air inlet may be formed from a single elongate aperture. The third air inlet may comprise a plurality of elongate apertures. The third air inlet may comprise two or three elongate apertures.

The first compartment the second compartment of the cartridge may be arranged symmetrically with respect to each other within the cartridge. Preferably, the cartridge is substantially cylindrical and the first compartment and the second compartment of the cartridge are arranged symmetrically about the major axis of the cartridge.

The cartridge and the mouthpiece may be formed from any suitable material or combination of materials. Suitable materials include, but are not limited to, aluminium, polyether ether ketone (PEEK), polyimides, such as Kapton®, polyethylene terephthalate (PET), polyethylene (PE), high-density polyethylene (HDPE), polypropylene (PP), polystyrene (PS), fluorinated ethylene propylene (FEP), polytetrafluoroethylene (PTFE), polyoxymethylene (POM), epoxy resins, polyurethane resins, vinyl resins, liquid crystal polymer (LCP), and modified LCP, such as LCP with graphite or glass fibres.

The cartridge may be formed from one or more materials that are nicotine-resistant and acid-resistant.

Advantageously, the cartridge and mouthpiece are formed from one or more materials selected from the group consisting of polyether ether ketone (PEEK), polyoxymethylene (POM), high-density polyethylene (HDPE) and other semicrystalline thermoplastic polymers.

The cartridge and the mouthpiece may be formed by any suitable method. Suitable methods include, but are not limited to, deep drawing, injection moulding, blistering, blow forming and extrusion.

The cartridge may be designed to be disposed of once the nicotine and the acid in the first and second compartments are depleted.

The cartridge may be designed to be refillable.

The mouthpiece may be designed to be disposed of once the nicotine and the acid in the first and second compartments of the cartridge are depleted.

The mouthpiece may be designed to be reusable.

The cartridge may have any suitable shape. Preferably, the cartridge is substantially cylindrical. As used herein with reference to the invention, the terms "cylinder" and "cylindrical" refer to a substantially right circular cylinder with a pair of opposed substantially planar end faces.

The cartridge may have any suitable size. The cartridge may have a length of, for example, between about 5 mm and about 50 mm. For example, the cartridge may have a length of about 20 mm. The cartridge may have a diameter of, for example, between about 4 mm and about 10 mm. For example, the cartridge may have a diameter of between about 7 mm and about 8 mm.

The combination of the cartridge and the mouthpiece may simulate the shape and dimensions of a combustible smoking article, such as a cigarette, a cigar, or a cigarillo. Preferably, the combination of the cartridge and the mouthpiece simulates the shape and dimensions of a cigarette.

As described further below, the cartridge may comprise a cavity for receiving a heater configured to heat the first compartment and the second compartment. The cartridge may comprise a cavity containing a susceptor for inductively heating the first compartment and the second compartment.

Preferably, the cartridge is substantially cylindrical and the cavity extends along the major axis of the cartridge. In such embodiments, the cavity is preferably located between the first and second compartments, that is the first and second compartments are preferably disposed on either side of the cavity.

The nicotine source may comprise one or more of nicotine, nicotine base, a nicotine salt, such as nicotine-HCl, nicotine-tartrate, or nicotine-ditartrate, or a nicotine derivative.

The nicotine source may comprise natural nicotine or synthetic nicotine.

The nicotine source may comprise pure nicotine, a solution of nicotine in an aqueous or non-aqueous solvent or a liquid tobacco extract.

The nicotine source may further comprise an electrolyte forming compound. The electrolyte forming compound may be selected from the group consisting of alkali metal hydroxides, alkali metal oxides, alkali metal salts, alkaline earth metal oxides, alkaline earth metal hydroxides and combinations thereof.

For example, the nicotine source may comprise an electrolyte forming compound selected from the group consisting of potassium hydroxide, sodium hydroxide, lithium oxide, barium oxide, potassium chloride, sodium chloride, sodium carbonate, sodium citrate, ammonium sulfate and combinations thereof In certain embodiments the nicotine source may comprise an aqueous solution of nicotine, nicotine base, a nicotine salt or a nicotine derivative and an electrolyte forming compound. The nicotine source may further comprise other components including, but not limited to, natural flavours, artificial flavours and antioxidants.

The nicotine source may comprise a sorption element and nicotine sorbed on the sorption element.

The sorption element may be formed from any suitable material or combination of materials. For example, the sorption element may comprise one or more of glass, cellulose, ceramic, stainless steel, aluminium, polyethylene (PE), polypropylene, polyethylene terephthalate (PET), poly (cyclohexanedimethylene terephthalate) (PCT), polybutylene terephthalate (PBT), polytetrafluoroethylene (PTFE), expanded polytetrafluoroethylene (ePTFE), and BAREX®.

The sorption element may be a porous sorption element. For example, the sorption element may be a porous sorption element comprising one or more materials selected from the group consisting of porous plastic materials, porous polymer fibres and porous glass fibres.

The sorption element is preferably chemically inert with respect to nicotine.

The sorption element may have any suitable size and shape.

In certain embodiments the sorption element may be a substantially cylindrical plug. For example, the sorption element may be a porous substantially cylindrical plug.

In other embodiments the sorption element may be a substantially cylindrical hollow tube. For example, the sorption element may be a porous substantially cylindrical hollow tube.

The size, shape and composition of the sorption element may be chosen to allow a desired amount of nicotine to be sorbed on the sorption element.

The sorption element advantageously acts as a reservoir for the nicotine.

The acid source may comprise an organic acid or an inorganic acid. Preferably, the acid source comprises an organic acid, more preferably a carboxylic acid, most preferably lactic acid or an alpha-keto or 2-oxo acid.

Advantageously, the acid source comprises an acid selected from the group consisting of lactic acid, 3-methyl-2-oxopentanoic acid, pyruvic acid, 2-oxopentanoic acid, 4-methyl-2-oxopentanoic acid, 3-methyl-2-oxobutanoic acid, 2-oxooctanoic acid and combinations thereof. Advantageously, the acid source comprises lactic acid or pyruvic acid.

The acid source may comprise a sorption element and acid sorbed on the sorption element.

The sorption element may be formed from any suitable material or combination of materials, for example those listed above.

The sorption element is preferably chemically inert with respect to the acid.

The sorption element may have any suitable size and shape.

In certain embodiments the sorption element may be a substantially cylindrical plug. For example, the sorption element may be a porous substantially cylindrical plug.

In other embodiments the sorption element may be a substantially cylindrical hollow tube. For example, the sorption element may be a porous substantially cylindrical hollow tube.

The size, shape and composition of the sorption element may be chosen to allow a desired amount of acid to be sorbed on the sorption element.

The sorption element advantageously acts as a reservoir for the acid.

In any of the embodiments described above, the aerosol-generating system may further comprise an aerosol-generating device, the aerosol-generating device comprising a housing defining a cavity for receiving at least a portion of the cartridge, and a heater for heating one or both of the first compartment and the second compartment of the cartridge.

Advantageously, in use, heating one or both of the first compartment and the second compartment to a temperature above ambient temperature enables the vapour concentrations of the nicotine and the acid in the first and second compartments respectively to be controlled and balanced proportionally to yield an efficient reaction stoichiometry between the nicotine and the acid. Advantageously, this may improve the efficiency of the formation of nicotine salt particles and the consistency of delivery to a user. Advantageously, it may also reduce the delivery of unreacted nicotine and unreacted acid to a user.

The mouthpiece may be attached to the cartridge for disposal with the cartridge when the nicotine and the acid have been depleted from the first and second compartments.

The mouthpiece may be configured to be removably attached to at least one of the aerosol-generating device and the cartridge.

The heater is preferably configured to heat both the nicotine source and the acid source. In certain preferred embodiments, the heater is configured to heat both the nicotine source and the acid source to a temperature of below about 250 degrees Celsius (° C.). Preferably, the heater is configured to heat both the nicotine source and the acid source to a temperature of between about 80° C. and about 150° C., or between about 100° C. and about 120° C.

Preferably, the heater is configured to heat the nicotine source and the acid source to substantially the same temperature.

As used herein with reference to the invention, by "substantially the same temperature" it is meant that the difference in temperature between the nicotine source and the acid source measured at corresponding locations relative to the heater is less than about 3° C.

The heater may be an electrical heater.

The heater may be located within the cavity of the aerosol-generating device and the cartridge may comprise a heater cavity for receiving the heater, as described above. The heater may be a resistive heater.

The heater may be arranged to circumscribe at least a portion of the cartridge when the cartridge is received within the cavity. The heater may be a resistive heater. The heater may be an inductive heater and the cartridge may comprise a susceptor received within a cavity, as described above.

In embodiments in which the heater is an electrical heater, the aerosol-generating system may further comprise a power supply for supplying power to the heater and a controller configured to control a supply of power from the power supply to the heater.

The aerosol-generating device may further comprise one or more temperature sensors configured to sense the temperature of the heater and the first and second compartments of the cartridge. In such embodiments, the controller may be configured to control a supply of power to the heater based on the sensed temperature.

The heater may be a non-electric heating means, such as a chemical heating means.

The heater may comprise a heat sink or heat exchanger configured to transfer thermal energy from an external heat source to one or both of the first and second compartments of the cartridge. The heat sink or heat exchanger may be formed of any suitable thermally conductive material. Suitable thermally conductive materials include, but are not limited to, metals, such as aluminium and copper.

The invention is further described, by way of example only, with reference to the accompanying drawings in which.

Figure 1:
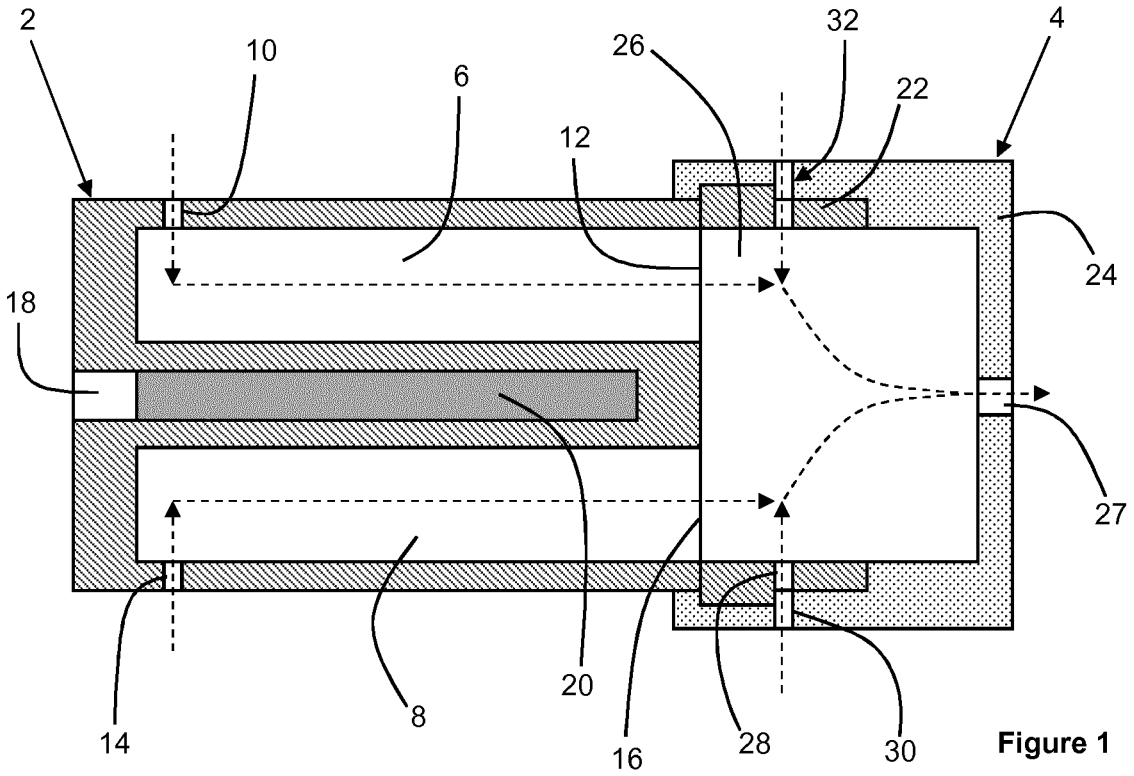
FIG. 1 shows a longitudinal cross-sectional view of a cartridge and a mouthpiece in accordance with a first embodiment of the present invention.

FIG. 1 shows a longitudinal cross-sectional view of a cartridge 2 and a mouthpiece 4 in accordance with a first embodiment of the present invention. The cartridge 2 comprises a first compartment 6 containing a nicotine source and a second compartment 8 containing an acid source. The nicotine source may comprise a sorption element, such as a PTFE wick, with nicotine adsorbed thereon, which is received within the first compartment 6. The acid source may comprise a sorption element, such as a PTFE wick, with acid adsorbed thereon, which is received within the second compartment 8. The acid may be, for example, lactic acid.

The first compartment 6 comprises a first air inlet 10 and a first air outlet 12, and the second compartment comprises a second air inlet 14 and a second air outlet 16. During use, air is drawn into the cartridge 2 through the first and second air inlets 10, 14 and out of the cartridge 2 through the first and second air outlets 12, 16, as illustrated by the dashed arrows in FIG. 1.

The cartridge 2 further comprises a cartridge cavity 18 extending between the first and second compartments 6, 8 and a susceptor 20 positioned within the cartridge cavity 18.

The mouthpiece 4 comprises a first mouthpiece part 22 and a second mouthpiece part 24. The first mouthpiece part 22 comprises a tubular portion extending from and formed integrally with the downstream end of the cartridge 2. The second mouthpiece part 24 is rotatably connected to the first mouthpiece part 22 so that the second mouthpiece part 24 can rotate with respect to the first mouthpiece part 24.

The mouthpiece 4 defines a chamber 26 into which airflow from the first and second air outlets 12, 16 is received. During use, nicotine vapour and acid vapour entering the chamber 26 from the first and second compartments 6, 8 mix together and react to form an aerosol of nicotine salt particles, which is delivered to a user through a third air outlet 27 in the mouthpiece 4.

The first mouthpiece part 22 comprises a first plurality of apertures 28 and the second mouthpiece part 24 comprises a second plurality of apertures 30. The combination of the first plurality of apertures 28 and the second plurality of apertures 30 forms a third air inlet 32 through which air can enter the chamber 26 directly from the exterior of the mouthpiece 4.

Figure 2:
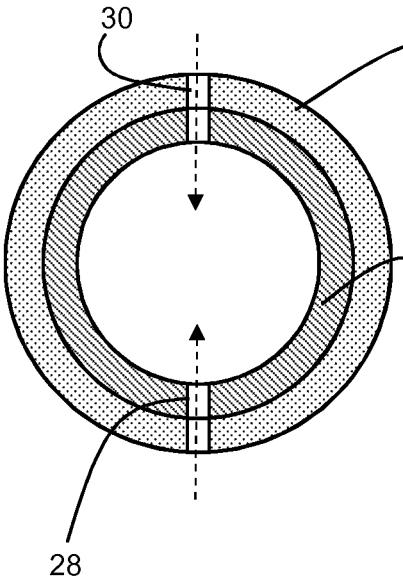
FIG. 2 shows a lateral cross-sectional view of the cartridge and the mouthpiece of FIG. 1 in a first configuration.
Figure 3:
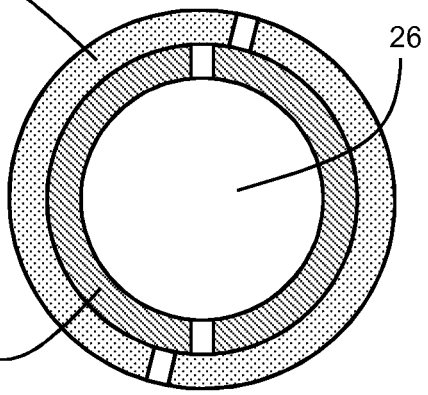
FIG. 3 shows a lateral cross-sectional view of the cartridge and the mouthpiece of FIG. 1 in a second configuration.

The second mouthpiece part 24 is rotatable with respect to the first mouthpiece part 22 from a first position shown in FIG. 2, through an intermediate second position, to a third position shown in FIG. 3. In the first position, shown in FIG. 2, the first plurality of apertures 28 is fully aligned with the second plurality of apertures 30 to provide the maximum flow area of the third air inlet 32. In the third position, shown in FIG. 3, the first plurality of apertures 28 does not align with any portion of the second plurality of apertures 30 so that the third air inlet 32 is entirely obstructed. Therefore, the third position shown in FIG. 3 represents the minimum flow area (zero) of the third air inlet 32. In the intermediate second position (not shown) between the first and third positions, the first plurality of apertures 28 is partially aligned with the second plurality of apertures 30 so that the third air inlet 32 is only partially obstructed. Therefore, in the second position, the third air inlet 32 has a flow area between the maximum flow area and the minimum flow area. By varying the flow area of the third air inlet 32, a user can vary the flow rate of air entering the chamber 26 through the third air inlet 32, which varies the total delivery of nicotine salt particles per unit volume of airflow through the third air outlet 27.

Figure 4:
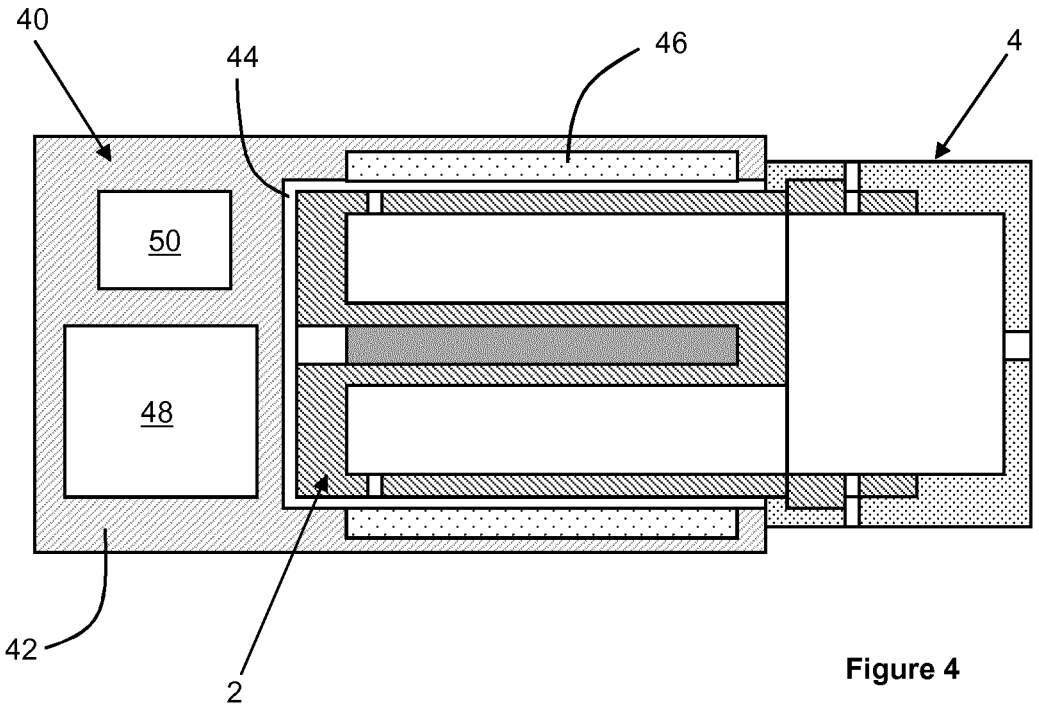
FIG. 4 shows a longitudinal cross-sectional view of the cartridge and the mouthpiece of FIG. 1 combined with an aerosol-generating device.

FIG. 4 shows the cartridge 2 and the mouthpiece 4 of FIG. 1 combined with an aerosol-generating device 40. The aerosol-generating device 40 comprises a housing 42 defining a cavity 44 for receiving the cartridge 2 and an inductive heater 46 circumscribing the cavity 44. The device 40 further comprises a power supply 48 and a controller 50 for controlling a supply of power from the power supply 48 to the inductive heater 46. During use, the controller 50 controls the supply of power from the power supply 48 to the inductive heater 46 to heat the susceptor 20 received within the cartridge cavity 18 of the cartridge 2. The susceptor 20, once heated, heats the first compartment 6 and the second compartment 8 to volatilise the nicotine and the acid received within the first and second compartments 6, 8.

Figure 5:
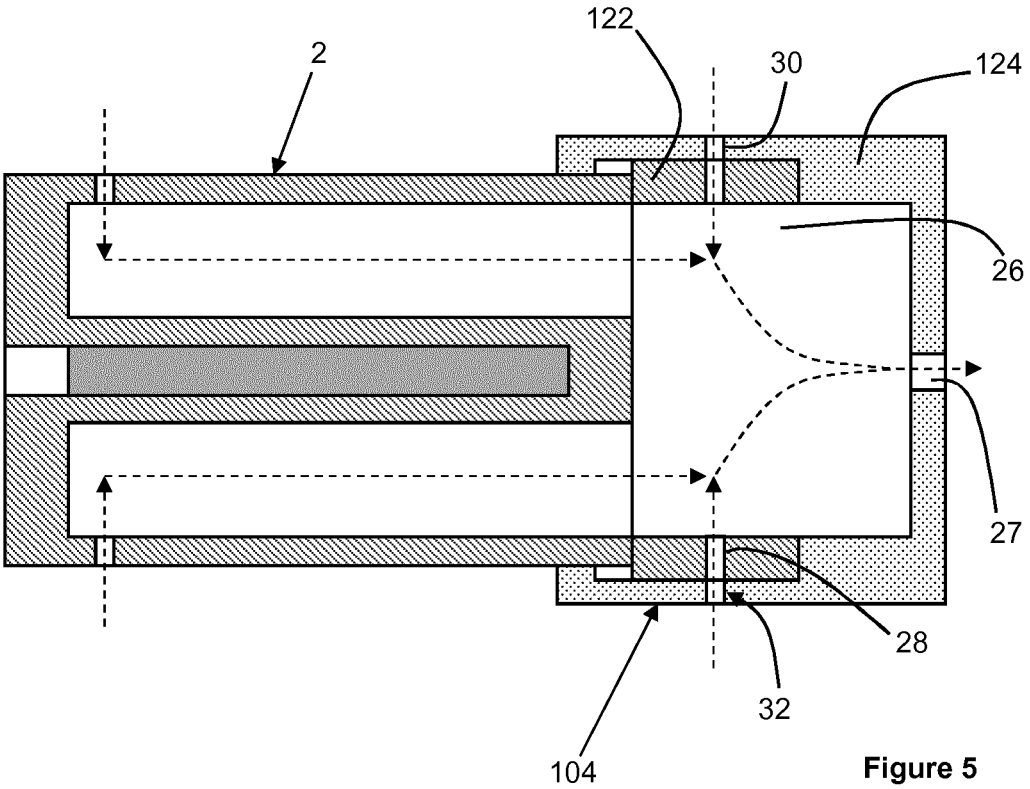
FIG. 5 shows a longitudinal cross-sectional view of a cartridge and a mouthpiece in accordance with a second embodiment of the present invention and in a first configuration.
Figure 6:
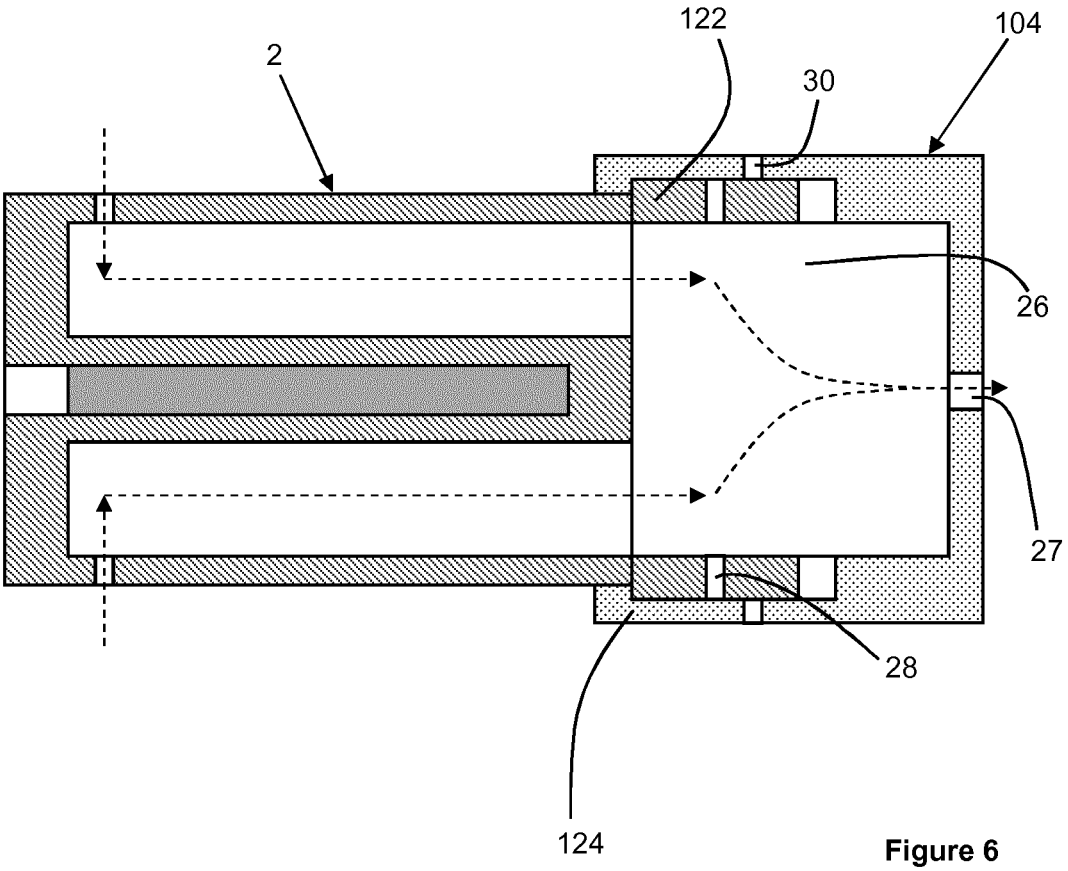
FIG. 6 shows a longitudinal cross-sectional view of the cartridge and the mouthpiece of FIG. 5 in a second configuration.

FIGS. 5 and 6 show a cartridge 2 and a mouthpiece 104 in accordance with a second embodiment of the present invention. The cartridge 2 is identical to the cartridge 2 described with reference to FIG. 1. The mouthpiece 104 is similar to the mouthpiece 4 described with reference to FIG. 1 and like reference numerals are used to designate like parts.

The mouthpiece 104 shown in FIGS. 5 and 6 comprises a first mouthpiece part 122 and a second mouthpiece part 124. The first mouthpiece part 122 comprises a tubular portion extending from and formed integrally with the downstream end of the cartridge 2. The second mouthpiece part 124 is slidably connected to the first mouthpiece part 122 so that the second mouthpiece part 124 can slide with respect to the first mouthpiece part 124.

The mouthpiece 104 defines a chamber 26 into which airflow from the first and second air outlets 12, 16 is received. During use, nicotine vapour and acid vapour entering the chamber 26 from the first and second compartments 6, 8 mix together and react to form an aerosol of nicotine salt particles, which is delivered to a user through a third air outlet 27 in the mouthpiece 104.

The first mouthpiece part 122 comprises a first plurality of apertures 28 and the second mouthpiece part 124 comprises a second plurality of apertures 30. The combination of the first plurality of apertures 28 and the second plurality of apertures 30 forms a third air inlet 32 through which air can enter the chamber 26 directly from the exterior of the mouthpiece 104.

The second mouthpiece part 124 is slidable with respect to the first mouthpiece part 122 from a first position shown in FIG. 5, through an intermediate second position, to a third position shown in FIG. 6. In the first position, shown in FIG. 5, the first plurality of apertures 28 is fully aligned with the second plurality of apertures 30 to provide the maximum flow area of the third air inlet 32. In the third position, shown in FIG. 6, the first plurality of apertures 28 does not align with any portion of the second plurality of apertures 30 so that the third air inlet 32 is entirely obstructed. Therefore, the third position shown in FIG. 6 represents the minimum flow area (zero) of the third air inlet 32. In the intermediate second position (not shown) between the first and third positions, the first plurality of apertures 28 is partially aligned with the second plurality of apertures 30 so that the third air inlet 32 is only partially obstructed. Therefore, in the second position, the third air inlet 32 has a flow area between the maximum flow area and the minimum flow area. By varying the flow area of the third air inlet 32, a user can vary the flow rate of air entering the chamber 26 through the third air inlet 32, which varies the total delivery of nicotine salt particles per unit volume of airflow through the third air outlet 27.

The invention claimed is:

1. An aerosol-generating system, comprising:

a cartridge comprising:

a first compartment containing a nicotine source, the first compartment having a first air inlet and a first air outlet, and a second compartment containing an acid source, the second compartment having a second air inlet and a second air outlet; and a mouthpiece configured to engage with the cartridge to define a chamber in fluid communication with the first air outlet and the second air outlet, the mouthpiece comprising a third air inlet in fluid communication with the chamber and a third air outlet in fluid communication with the chamber, wherein the third air inlet defines a flow area, wherein the mouthpiece is configured so that the flow area through the third air inlet is variable, wherein the third air inlet comprises a first aperture proximate the first air outlet, and wherein the third air inlet further comprises a second aperture opposite the first aperture and proximate the second air outlet.

2. The aerosol-generating system according to claim 1, wherein the mouthpiece further comprises a first mouthpiece part and a second mouthpiece part moveable with respect to the first mouthpiece part, and wherein relative movement between the first mouthpiece part and the second mouthpiece part varies the flow area through the third air inlet.

3. The aerosol-generating system according to claim 2, wherein the second mouthpiece part is moveable with respect to the first mouthpiece part between a first position in which the first and the second apertures are unobstructed and a second position in which at least a portion of each of the first and the second apertures is obstructed.

4. The aerosol-generating system according to claim 1, wherein a maximum flow area of the third air inlet is between 1.5 square millimeters and 2 square millimeters.

5. The aerosol-generating system according to claim 1, wherein a minimum flow area of the third air inlet is less than 0.6 square millimeters.

6. The aerosol-generating system according to claim 1, wherein the third air inlet comprises a plurality of apertures, and wherein a total number of apertures is between 2 and 10.

7. The aerosol-generating system according to claim 1, wherein each of the one first and the second apertures is substantially circular.

8. The aerosol-generating system according to claim 1, wherein each of the one first and the second apertures is elongate.

9. The aerosol-generating system according to claim 1, wherein the acid source comprises lactic acid.

10. The aerosol-generating system according to claim 1, further comprising an aerosol-generating device comprising:

a housing defining a cavity configured to receive at least a portion of the cartridge; and a heater configured to heat one or both of the first compartment and the second compartment of the cartridge.

11. The aerosol-generating system according to claim 10, wherein the mouthpiece is further configured to attach to at least one of the cartridge and the aerosol-generating device.

12. The aerosol-generating system according to claim 10, wherein the heater is disposed within the cavity of the aerosol-generating device, and wherein the cartridge comprises a heater cavity configured to receive the heater.

13. The aerosol-generating system according to claim 10, wherein the heater is arranged to circumscribe at least a portion of the cartridge when the cartridge is received within the cavity.

14. The aerosol-generating system according to claim 10, wherein the heater is a resistive heater.

15. The aerosol-generating system according to claim 10, wherein the heater is an inductive heater, and wherein the cartridge comprises at least one susceptor.

16. The aerosol-generating system according to claim 1, wherein the nicotine source comprises a first sorption element with nicotine adsorbed thereon, and wherein the acid source comprises a second sorption element with lactic acid adsorbed thereon.

17. The aerosol-generating system according to claim 2, wherein the first mouthpiece part comprises a tubular portion extending from and formed integrally with a downstream end of the cartridge, and wherein the second mouthpiece part is rotatably connected to the first mouthpiece part.

* * * * *